US005638551A

United States Patent [19]

Lallemand

[11] Patent Number: 5,638,551

[45] Date of Patent: Jun. 17, 1997

[54] HELMET INCLUDING A DEVICE FOR FIXING THE HELMET TO THE OCCIPITAL PORTION OF A USER'S HEAD

[75] Inventor: Jean-Luc Lallemand, Poitiers, France

[73] Assignee: Societe a Responsabilite Limitee Dite Overforing, Neuville de Poitou, France

[21] Appl. No.: 435,154

[22] Filed: May 5, 1995

[30] Foreign Application Priority Data

May 10, 1994 [FR] France ..... 94 06014

[51] Int. Cl.[6] ..... A42B 3/08

[52] U.S. Cl. ..... 2/421; 2/425

[58] Field of Search ..... 2/410, 411, 415, 2/417, 418, 420, 421, 422, 425

[56] References Cited

U.S. PATENT DOCUMENTS

| | | | |
|---|---|---|---|
| 2,814,043 | 11/1957 | Alesi | 2/421 |
| 2,846,683 | 9/1958 | Dye et al. | 2/421 |
| 3,230,544 | 1/1966 | Mager | 2/415 |
| 3,323,134 | 6/1967 | Swyers . | |
| 3,591,863 | 7/1971 | Rickard | 2/421 |
| 3,852,821 | 12/1974 | Mickel . | |
| 4,477,929 | 10/1984 | Mattsson | 2/425 |
| 4,703,879 | 11/1987 | Kastendieck et al. | 2/422 |
| 4,856,119 | 8/1989 | Haberle . | |
| 4,884,301 | 12/1989 | Aileo . | |
| 5,179,735 | 1/1993 | Thomanek | 2/421 |
| 5,272,773 | 12/1993 | Kamata | 2/421 |
| 5,315,718 | 5/1994 | Barson et al. | 2/418 |
| 5,381,560 | 1/1995 | Halstead | 2/421 |
| 5,551,094 | 9/1996 | Navone | 2/421 |
| 5,572,749 | 11/1996 | Ogden | 2/421 |

FOREIGN PATENT DOCUMENTS

| | | | |
|---|---|---|---|
| 0302211 | 2/1989 | European Pat. Off. . | |
| 0346618 | 12/1989 | European Pat. Off. . | |
| 95/01739 | 1/1995 | WIPO | 2/421 |

*Primary Examiner*—Michael A. Neas

*Attorney, Agent, or Firm*—Greenblum & Bernstein P.L.C.

[57] ABSTRACT

The present invention is directed to helmet, and, more particularly, a device for adjusting the occipital fixing of a cyclist helmet. A shell fits the skull of the cyclist. Straps integral with side walls of the shell are linked on each side at a single point with a clip. A housing in the shell receives an plate of an occipital support block, articulated with respect to the helmet, which connect through a spindle. At least one occipital strap in the support block assists in lateral adjustment of the support block.

32 Claims, 4 Drawing Sheets

HELMET INCLUDING A DEVICE FOR FIXING THE HELMET TO THE OCCIPITAL PORTION OF A USER'S HEAD

BACKGROUND OF THE INVENTION

1. Field of the Invention

The present invention concerns a device for the occipital fixing of a helmet, in particular to a cyclist, as well as the helmet provided with the device.

2. Description of Background and Relevant Information

There are a number of aerodynamic cyclist helmets which are extremely light yet provide the wearer with sufficient protection against impacts and the required comfort, especially with regard to ventilation. The materials used and the shape provide good air penetration with only a slight amount of drag to avoid impairing the physical performance of the wearer and reduce the effort required to support the head with the muscles of the neck.

Moreover, these helmets should be easily placed on and removed from the head.

However, there is still a problem in wearing these helmets, particularly travelling cross-country. Specifically, this helmet is supported by side straps. Under repeated vibrations due to movements over a land surface, however, the helmet tilts from the front to the rear and from the rear forwards. This may compromise the safety of the wearer, who is unable to correct the positioning during motion.

Even more important, during a fall, the helmet must be positioned precisely with respect to the cranium of the user. Misalignment of the helmet could cause serious injuries if the head of the user strikes the ground.

Each side strap of the prior art helmets generally forms the shape of a V, one of the branches of this V being disposed upstream of the front/rear tilting point of the helmet and the other being downstream to reduce tilting.

This disposition is inadequate to obtain maximum safety.

Above all, it is essential that the helmet remains on the head of the user without being pulled up or off by the first impact or immediately prior to this first impact. In many cases, the helmet tends to be pulled off under the effect of the first impact and the wearer is no longer protected against any possible subsequent impacts.

This applies to non-covering helmets, such as the aerodynamic helmets described above whose tilting amplitude may result in the helmet being torn or moved. In these cases, particularly sensitive areas of the skull are no longer protected.

Accordingly, there exists a light helmet described in the patent EP-A-302.211. This helmet is non-covering whose shape is approximately hemispherical (like a skullcap) and includes two straps. One strap is secured to the front of the helmet including a chin strap. The other strap is secured to the base of the helmet at a rear point in its median zone. The two free ends are connected on each side to the first strap.

In this type of helmet, the latter remains limited in being secured to the head in that the strap is properly secured to the rear of the helmet, but may marry the shape of the occipital portion of the cranium and slide on both sides of this portion.

SUMMARY OF THE INVENTION

The present invention concerns an occipital fixing device which limits the front and rear movements of the helmet, and allows for an extremely rapid change of the occipital support block to better adapt to the profile of the cranium. The present invention is comfortable, orientated automatically and without needing to be forced, and can be adapted for various types of cycling: track cycling, all-purpose cycling, riding on roadways, cross-country cycling, tourist cycling.

To this end, the adjustable occipital device of the invention for fixing a helmet, especially a cyclist helmet includes a shell adapted to the cranium of the cyclist. Straps integral with the side walls of this shell are linked on each side at a single point equipped with a movable fast coupling and uncoupling linking device. The device includes an articulated plate integral with respect to the rear edge of the shell of the helmet, an occipital support block and at least one occipital strap integral with this occipital support block and the plate.

According to one preferred embodiment for making the most of all the advantages of the present device, a housing in the rear of the helmet receives the articulated plate includes a first element integral with the helmet, a second articulated element with respect to the first with a mechanism for linking the occipital support block and at least one occipital strap integral with the second element.

In this embodiment, the first element is an spindle mounted transversally with respect to the longitudinal axis of the helmet. The second element is an oblong plate fitted at one of its ends with a hole having a diameter identical to that of the spindle, at the other end with a mechanism for linking the occipital support block, and in an intermediate position a strap passage slit.

According to one characteristic of the invention, the spindle includes a median throat for receiving the peripheral edge of the hole of the plate.

More specifically, the linking mechanism of the occipital support block on the second element includes a polymer duplicate molding.

According to another characteristic of the device, the peripheral edge of the hole of the second element includes a thinned circular lip whose inner diameter is between the nominal diameter of the spindle and the diameter of the spindle at the bottom of the throat so that the plate is translation-locked in the throat of the spindle.

In addition, the occipital support block includes strap passage slits so as to ensure a correct lateral positioning of the strap on both sides of the second element.

According to one improvement concerning comfort, the occipital support block is flexible and includes a comfortable covering to cooperate with the occipital portion of the cranium of the user.

According to one embodiment variant, the plate includes a short strap integral with the helmet via one of its ends, the other end bearing a buckle for housing the occipital strap and an occipital support block sliding freely on said occipital strap on both sides of the short strap.

According to one characteristic common to the various embodiments, the occipital strap is linked to side straps and the fast hooking/unhooking movable link.

BRIEF DESCRIPTION OF THE DRAWINGS

The present invention is described hereafter according to one particular embodiment of an occipital fixing device with reference to the accompanying drawings illustrating said device.

On these drawings, the following figures respectively represent.

DETAILED DESCRIPTION OF PREFERRED EMBODIMENT

Figure 1:
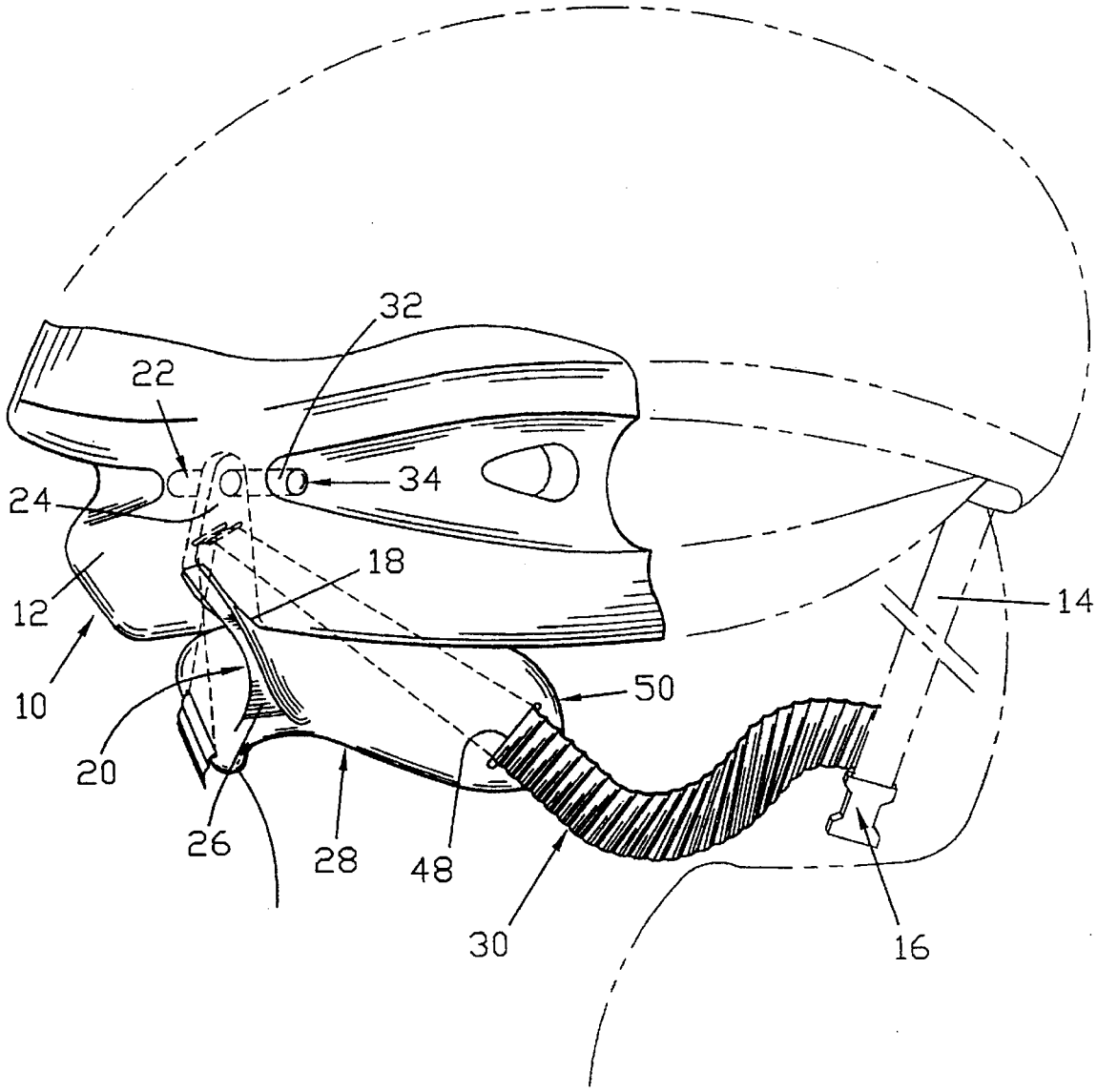
FIG. 1 is a perspective view of the rear of a cyclist helmet equipped with the device of the present invention.

In FIG. 1, the helmet 10 and the shell 12 are mainly made of polystyrene.

Shell 12 is of the non-covering type designed such that its inner shape matches as closely as possible the shape of the cranium of the user, and can be easily placed and removed.

Shell 12 also includes a strap 14 which passes through shell 12 and extends downwardly from a forward portion of the shell to either lateral side of the user's head, and whose free ends are equipped with a fast hooking/unhooking movable link 16 positioned beneath and apart from said shell, one element of the link being visible in FIG. 1.

According to the preferred embodiment of the invention, a housing 18 is fitted inside this shell 12. Mounted inside housing 18 is a connection plate 20, which includes a first element 22 integral with this shell 12 and a second mobile element 24.

Also provided in said preferred embodiment are means 26 for linking an occipital support block 28 with an occipital strap 30. As can be seen in FIG. 1, for example, the plate 20, means 26, and the occipital support block 28 are preferably formed as a unitary occipital support device, i.e., they are preferably formed as a single member.

The first element 22 is a cylinder forming a spindle 32 mounted in a hole 34 in a rear end portion of the shell 12 behind the user's head.

Figure 2:
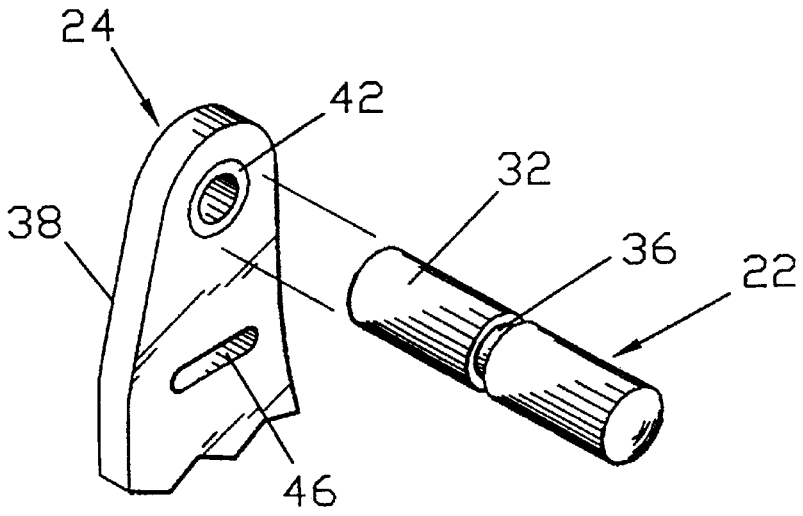
FIG. 2 is an exploded detailed view of the first and second elements of the articulated plate.

The cylinder 32, shown alone on FIG. 2, includes a throat 36 in its median portion.

Figure 3:
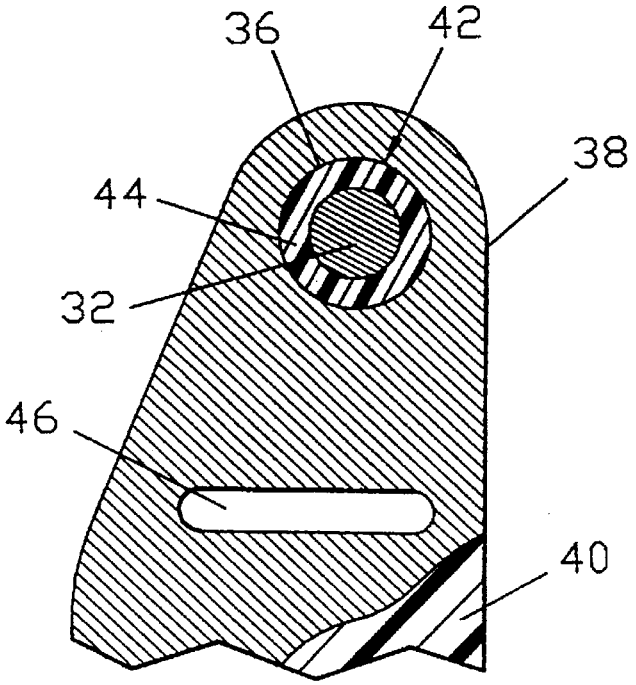
FIG. 3 is a cutaway view of the first and second elements assembled along a transverse plane passing through the throat bottom.

The second element 24 is an oblong plate 38 with a polymer duplicate molding constituting a layer 40 (see FIG. 3). A hole 42 is provided in this plate 38, the diameter of said hole being almost identical to that of the spindle 32.

The layer 40 extends inside the hole 42 so as to form a thinned down lip at the edge of the hole, the inner diameter of the circular lip being equal the diameter of the spindle 32 measured at the bottom of the throat 36.

In addition, a slit 46 is provided in plate 38 for the passage of the occipital strap 30. The occipital support block 28 also includes slits 48 for passage of the occipital strap 30, which extends downwardly to either lateral side of the user's head near the rear, to connect with an element of the hooking/unhooking link 16 and the side straps 14.

This occipital support block 28 is semi-rigid and includes a comfort covering 50 for cooperating with the occipital portion of the user. Generally and in particular in the case illustrated, the covering identical to the one inside the helmet.

The shape of the second element 24 and that of the occipital support block 28 have been designed so as to avoid aerodynamic disturbances and exhibit an anatomic profile.

The duplicate moulding preferably allows for efficient linking of the occipital support block 28 with the second element 24, thus embodying a monolithic unit.

The mounting of the device of the invention is extremely simple. It merely suffices to dispose the second element 24 in the housing 18 and then introduce the spindle 32 into the hole 34.

The spindle penetrates into the hole 34 of the shell 12 and then into the hole 42 of the plate 38 thereby forming the second element.

The thin lip 44, whose dimensions have been deliberately exaggerated on FIG. 3, slides along the spindle. As soon as this lip encounters the throat 36 of the spindle 32, its stiffness looks this throat 36 which avoids translation movement of the spindle 32 and the second element 24 after mounting.

The second element 24 and the occipital support block 28 integral with it are orientated inside the median longitudinal plane by pivoting around the spindle 32. By means of this configuration, the plate is translation locked in the throat of the spindle.

The approximately V-shaped open shape is preferably inside the vertical plane of the second element 24 so as to prolong the shape of the helmet at the rear at the level of the bottom occipital portion and thus house the block under the occiput.

The strap 30 passes through the ends of the occipital block and is integral with the second element 24 by passing through the slit 46 and can be slide-adjusted.

In order to place the support block on the cranium of the user shown by the dotted lines, the occipital support block is first placed on the rear of the neck and pivoting downwards, for attachment to helmet by spindle 37. Straps 14 are then tightened and secured around the chin by linking means 16. The rear of strap 30 provides traction on the occipital block 28 against the bottom occipital portion under the occiput which prevents the helmet from being removed.

The simultaneous traction on strap 14 and locking under the chin ensures that the helmet is rendered immobile on the cranium. This design eliminates any possibility of the helmet being pulled off and significantly limits any tilting movements of the helmet.

The dimensions of the occipital support block 28 may vary or the positions of the slits 46 and 48 may be moved for guiding the strap and the point for linking with the side straps 14 allow for precise adjustment of the traction directions.

In all instances, the occipital block ensures guiding of the rear strap, which prevents this strap from moving when sliding along the lateral walls of the cranium which occurred in the prior art and constituted a danger to the wearer.

The embodiment has been clearly improved yet remains extremely simple in that plate 20 can be removed as easily as it is mounted.

Figure 4:
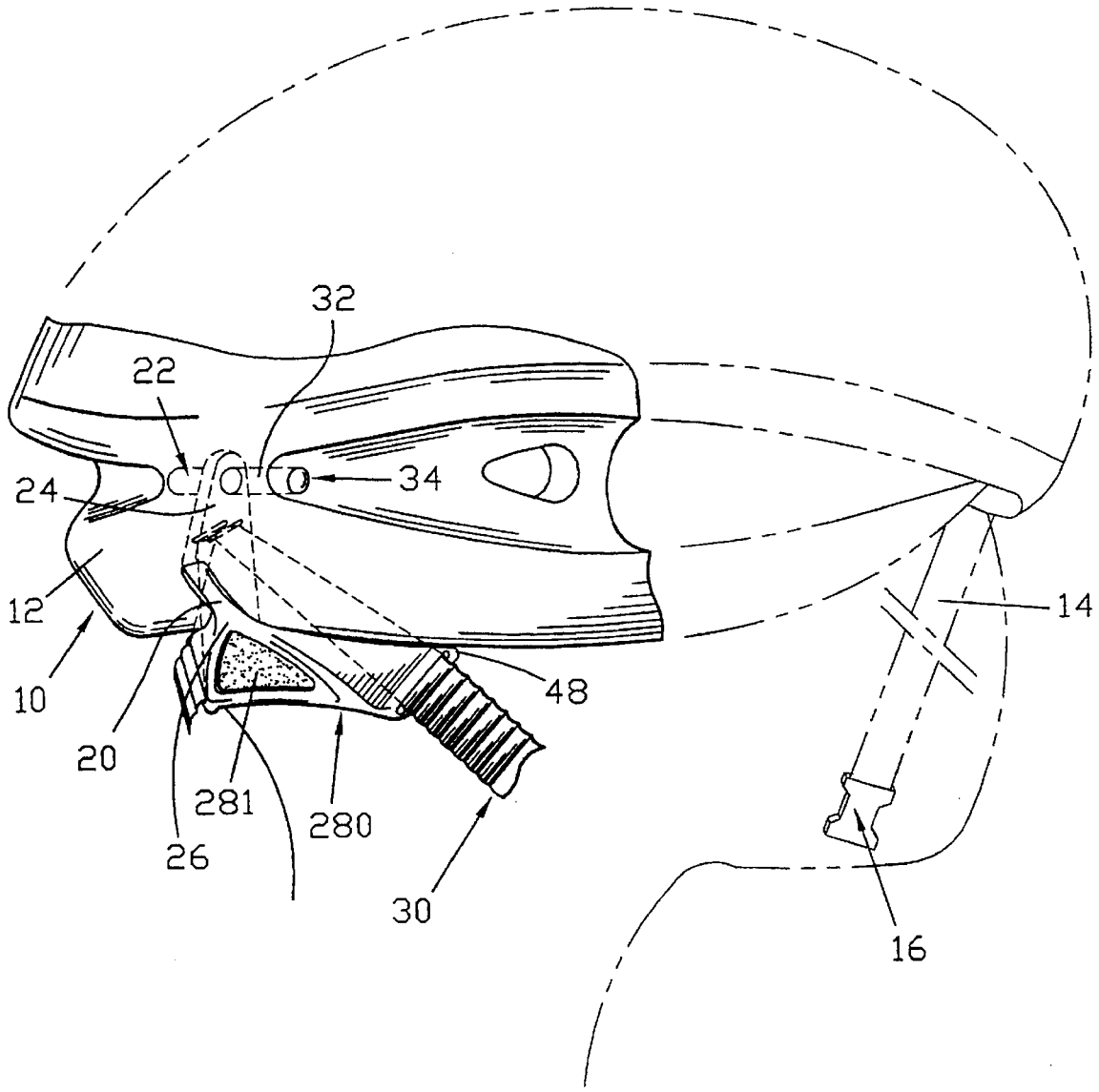
FIG. 4 is a perspective view of an embodiment variant of the device of the invention and applied to road cyclist helmets.

FIG. 4 shows a variant more specifically applicable for road cyclists.

In this case, the occipital support block 280 includes an additional damper material 281.

The other elements of the device are identical.

It is also possible to additionally provide means for locking the spindle 32 in the hole 34. These means, in particular a covering cap, can be easily provided.

The helmet equipped with the device of the invention offers increased side stability for the wearer.

The occipital support block can also be rigid or semi-rigid depending on its particular application.

According to another embodiment, the second element and the block can be manufactured in a single operation.

Figure 5:
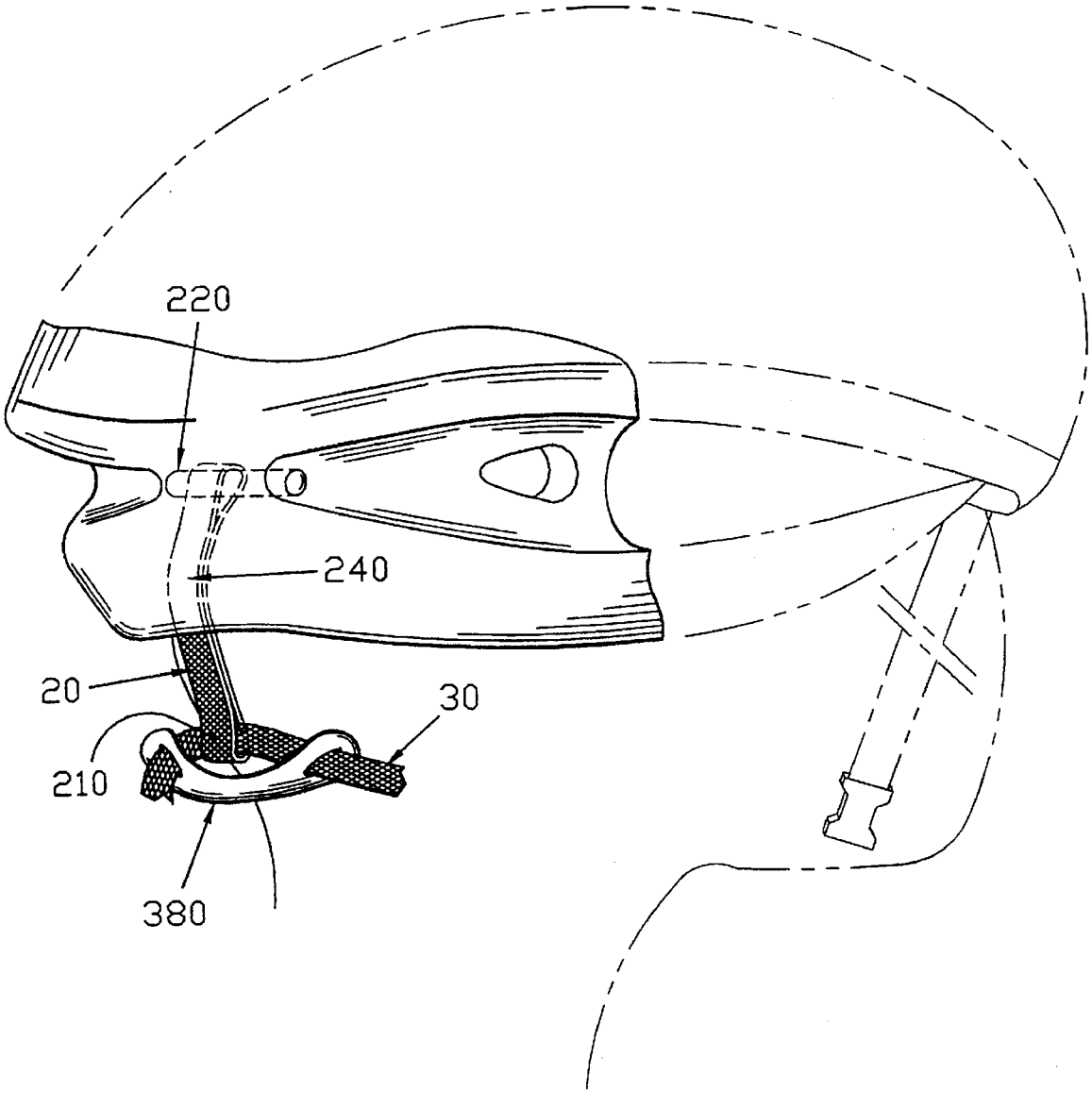
FIG. 5 is a perspective view of an embodiment variant of the device of the invention with a view to simplifying user comfort.

FIG. 5 shows another embodiment of the presentation which exhibits all of the safety qualities of other embodiments, but its disposition does not necessarily provide the same comfort, especially for fast adjustments.

In this embodiment, the first and second elements 220, 240 of the connection member 20 are simplified in that the rear strap 30 is equipped with a sliding block 380 and is sliding-mounted in the buckle or loop 210 of a short or connection strap 240 integral with the rear lower edge of the helmet, this short strap forming the second element.

The first element 220 can be eliminated as in this instance the short strap 240 is able to be fixed to the shell of the helmet and its flexibility allows for the same possibilities as the joining of as rigid element.

I claim:

1. A helmet comprising:

a support block having a shape adapted to fit a rear occipital portion of a user's cranium and having a first hole;

a shell having a shape adapted to fit a user's cranium, said shell having a housing for receiving said support block, said support block being movably connected to said shell, and said housing having a second hole aligned with said first hole;

at least one first strap being integral with said shell, said at least one first strap having first and second selectively connectable ends which can extend beneath a user's chin;

at least one second strap connected to said support block in a sliding manner for adjusting a lateral position of said support block in relation to said occipital portion of the user's cranium, said second strap being connected to said first strap; and a solid member passing through said first and second holes to connect said shell and said support block.

2. The helmet according to claim 1, said solid member being a spindle with a throat, said throat aligning with said first and second holes.

3. The helmet according to claim 2, wherein said first hole has a peripheral edge which engages said throat to inhibit removal of said spindle from said first and second holes.

4. A helmet according to claim 1, wherein said second strap extends from said shell and is connected to said first strap beneath said shell.

5. A helmet according to claim 1, wherein at least a portion of said support block extends beneath said shell.

6. A helmet comprising:

a support block having a shape adapted to fit a rear occipital portion of a user's cranium;

a shell having a shape adapted to fit a user's cranium;

at least one first strap connected to said shell, said at least one first strap having first and second selectively connectable ends which extend beneath a user's chin;

at least one second strap connected to said support block in a sliding manner for adjusting a lateral position of said support block in relation to said occipital portion of the user's cranium, said second strap being connected to said first strap; and a third strap connecting said support block for movement with respect to said shell.

7. A helmet according to claim 6, wherein said support block is movably connected to said shell by a spindle.

8. A helmet according to claim 6, wherein said second strap extends from said shell and is connected to said first strap beneath said shell.

9. A helmet according to claim 6, wherein said third strap extends downwardly from a rear of said shell and is connected to said support block beneath said shell.

10. A helmet comprising:

a support block having a shape adapted to fit a rear occipital portion of a user's cranium;

a shell having a shape adapted to fit the user's cranium, at least a portion of said block being covered by said shell and said block being movably connected to said shell;

one first strap integral with said shell, said at least one first strap having first and second ends which extend beneath the user's chin;

means for linking said first and second ends under the user's chin;

one second strap connected to said support block in a sliding manner for adjusting a lateral position of said support block in relation to the occipital portion of the user's cranium, said second strap being connected to said first strap.

11. A helmet according to claim 10, wherein said first strap extends downwardly from a forward portion of said shell for applying a downward force to said shell at said forward portion.

12. A helmet according to claim 10, wherein said second strap extends from said shell and is connected to said first strap beneath said shell.

13. A helmet according to claim 10, wherein:

at least a portion of said support block extends beneath said shell.

14. A helmet according to claim 10, wherein the helmet is a lightweight cyclist's helmet.

15. A helmet according to claim 10, wherein said shell is made mainly of polystyrene.

16. A helmet according to claim 10, wherein said support block is movably connected to said shell by a spindle.

17. The helmet according to claim 10, further comprising a dampening material in said support block.

18. The helmet according to claim 10, wherein said shell has a housing for receiving said support block.

19. A helmet comprising:

a shell adapted for being seated upon a user's head, said shell having a forward portion and a rearward portion, the rearward portion having a rear end portion, the rear end portion adapted to be positioned behind the user's head;

front strap portions connected to said forward portion of said shell and extending downwardly from said shell and being adapted to extend downwardly along opposite lateral sides of the user's head;

a coupling/uncoupling device for linking said front strap portions and extending beneath the user's chin, said coupling/uncoupling device enabling the helmet to be quickly affixed to and quickly removed from the user's head;

an occipital support block adapted to be positioned against a rear of the user's head;

a connection between said occipital support block and said rear end portion of said shell for enabling movement of said occipital support block with respect to said shell; and rear strap portions extending from said occipital support block and connected to said occipital support block for enabling lateral adjustment of said occipital support block with respect to an occipital portion of the user's head, said rear strap portions being connected to said front strap portions beneath and apart from said shell.

20. A helmet according to claim 19, wherein:

said connection between said occipital support device and said rear end portion of said shell comprises a plate and a linking portion between said plate and said occipital support block, said plate, said linking portion, and said occipital support block being formed as a unitary member;

said rear end portion of said shell includes a housing;

said plate is positioned within said housing;

said connection between said occipital support block and said rear end portion of said shell further comprises a connecting element integral with said shell, said plate being articulated to said connecting element for enabling said movement of said occipital support block with respect to said shell; and said rear strap portions comprise a rear strap slidably affixed to said occipital support block and is slidably affixed to said plate.

21. A helmet according to claim 20, wherein:

said connecting element is a spindle having a substantially circular cross section, said spindle being mounted transversely to said shell and traversing said housing of said shell;

said plate includes an opening through which said spindle extends, said opening having a diameter identical to said cross section of said spindle;

said plate further includes a slit, said slit being positioned between said opening of said plate and said linking portion of said connection; and said rear strap extending through said slit in said plate.

22. A helmet according to claim 21, wherein:

said spindle has a median throat positioned in said opening of said plate; and said opening of said plate has a peripheral edge engaging said median throat of said spindle.

23. A helmet according to claim 22, wherein:

said spindle has a nominal diameter and said median throat of said spindle has a diameter less than said nominal diameter;

said plate has a predetermined thickness and said throat has a width at least equal to said predetermined thickness of said plate; and said peripheral edge of said opening of said plate comprises a thinned circular lip having an inner diameter, said inner diameter having a dimension between said nominal diameter and said diameter of said throat, whereby said plate is translation locked in said throat of said spindle.

24. A helmet according to claim 20, wherein:

said linking portion is a duplicate molded polymer.

25. A helmet according to claim 20, wherein:

said plate extends generally along a median plane of said shell and said occipital support block comprises opposite lateral portions extending from respective sides of said plate; and each of said lateral portions of said occipital support block includes a slit through which said rear strap slidably extends.

26. A helmet according to claim 20, wherein:

said plate extends generally along a median plane of said shell and said occipital support block comprises opposite lateral portions extending from respective sides of said plate;

said plate further includes a slit, said rear strap extending for slidable adjustment through said slit in said plate; and each of said lateral portions of said occipital support block includes a slit, said rear strap extending from said slit in said plate downwardly through each of said slits in said lateral portions of said occipital support block for slidable adjustment of said rear strap.

27. A helmet according to claim 19, wherein:

said occipital support block is made of a flexible material and comprises a comfort covering for cooperation with the occipital portion of the head of the user.

28. A helmet according to claim 19, wherein:

said occipital support block comprises a damper material.

29. A helmet according to claim 19, wherein:

said connection between said occipital support block and said rear end portion of said shell comprises a connecting strap, said connecting strap extending downwardly from said rear end portion of said shell to an end having a loop;

said occipital support block having lateral portions extending on respective opposite sides of said connecting strap; and said rear strap portions comprise a rear strap slidably extending through a slit in one of said lateral portions of said occipital support block, slidably extending through said loop of said connecting strap, and slidably extending through a slit in a second of said lateral portions of said occipital support block.

30. A helmet according to claim 19, wherein:

on each lateral side of said shell, a respective one of said front strap portions extends downwardly and rearwardly from said shell to said coupling/uncoupling device and a respective one of said rear strap portions extends downwardly and forwardly from said shell to said coupling/uncoupling device.

31. A helmet according to claim 19, wherein:

the helmet is a lightweight cyclist's helmet.

32. A helmet according to claim 19, wherein:

said shell is made mainly of polystyrene.

* * * * *